US011655809B2

(12) United States Patent
McDonald et al.

(10) Patent No.: US 11,655,809 B2
(45) Date of Patent: May 23, 2023

(54) CRYOGENIC PUMP FLANGE

(71) Applicant: WESTPORT FUEL SYSTEMS CANADA INC., Vancouver (CA)

(72) Inventors: Robbi L. McDonald, Richmond (CA); Ankur H. Vayeda, Vancouver (CA); Gregory C. Harper, North Vancouver (CA); Kenneth W. Kratschmar, Vancouver (CA); Michael Ebbehoj, Vancouver (CA)

(73) Assignee: WESTPORT FUEL SYSTEMS CANADA INC., Vancouver (CA)

( * ) Notice: Subject to any disclaimer, the term of this patent is extended or adjusted under 35 U.S.C. 154(b) by 1075 days.

(21) Appl. No.: 16/283,708

(22) Filed: Feb. 22, 2019

(65) Prior Publication Data

US 2019/0186481 A1 Jun. 20, 2019

Related U.S. Application Data

(63) Continuation of application No. 14/904,412, filed as application No. PCT/CN2014/082030 on Jul. 11, 2014, now abandoned.

(30) Foreign Application Priority Data

Jul. 12, 2013 (CN) ..... 201310293540.9

(51) Int. Cl.
*F04B 39/12* (2006.01)
*F04B 15/08* (2006.01)
(Continued)

(52) U.S. Cl.
CPC ..... *F04B 39/121* (2013.01); *F04B 15/08* (2013.01); *F04B 37/08* (2013.01); *F04B 39/12* (2013.01);
(Continued)

(58) Field of Classification Search
CPC ..... F04B 15/08; F04B 15/06; F04B 39/123; F04B 39/12; F04B 37/08; F04D 29/60; F04D 29/601; F04D 29/403; F04D 13/16
See application file for complete search history.

(56) References Cited

U.S. PATENT DOCUMENTS 2,730,957 A 1/1956 Riede
3,016,717 A 1/1962 Gottzmann
(Continued)

FOREIGN PATENT DOCUMENTS

CN 202056021 U 11/2011
CN 102606820 A 7/2012
(Continued)

OTHER PUBLICATIONS

Extended European Search Report, dated May 22, 2017, for European Application No. 14822595.6-1616 / 3019747, 18 pages.
(Continued)

*Primary Examiner* — Deming Wan
(74) *Attorney, Agent, or Firm* — Seed IP Law Group LLP

(57) ABSTRACT

A flange for a pump comprises first and second faces and a passageway for cryogenic fluid flow extending from the first face to the second face and at least one of (1) the passageway is for a pipe and comprises a first portion of a first diameter and a second portion of a second diameter greater than the first diameter, wherein when the pipe has an outer diameter that is smaller than the second diameter a gap is formed between the pipe and the passageway where the pipe passes through the second portion; and (2) a first annular groove in one of the first face and the second face and extending around the passageway, wherein the first annular groove in cooperation with the passageway forms a bellows. The gap and bellows increase the thermal resistance between the passageway and the flange, and the bellows allows for
(Continued)

flexure during thermal contractions of the flange reducing thermal stress on welded fluid seals.

23 Claims, 7 Drawing Sheets

(51) Int. Cl.
*F04B 37/08* (2006.01)
*F04B 15/06* (2006.01)
*F04C 29/12* (2006.01)
*F04C 15/06* (2006.01)

(52) U.S. Cl.
CPC ..... *F04B 39/123* (2013.01); *F04C 15/06* (2013.01); *F04C 29/12* (2013.01); *F04C 2240/30* (2013.01); *F04C 2240/806* (2013.01); *F04C 2250/10* (2013.01); *F04C 2250/102* (2013.01); *Y10S 417/901* (2013.01)

(56) References Cited

U.S. PATENT DOCUMENTS 3,068,026 A 12/1962 McKamey
3,095,220 A 6/1963 Johnston et al.
3,109,293 A * 11/1963 Williams ..... F04B 53/00 62/52.1
3,136,136 A 6/1964 Gottzmann
3,220,202 A 11/1965 Gottzmann
4,472,946 A * 9/1984 Zwick ..... F04B 41/02 417/901
5,607,626 A * 3/1997 Kunkle ..... F22G 5/123 261/37
7,052,047 B1 * 5/2006 Box ..... F16L 59/184 62/50.7
7,607,898 B2 10/2009 Noble et al.
2007/0167931 A1 * 7/2007 Waller ..... A61M 25/0014 604/93.01

FOREIGN PATENT DOCUMENTS

CN 103363293 A 10/2013
CN 203655560 U 6/2014
EP 2 246 573 A2 11/2010
JP 55-149494 A 11/1980
KR 10-2011-0127477 A 11/2011

OTHER PUBLICATIONS

International Preliminary Report on Patentability, dated Sep. 24, 2015, for International Application No. PCT/CN2014/082030, 12 pages.
International Search Report and Written Opinion, dated Oct. 14, 2014, for International Application No. PCT/CN2014/082030, 16 pages.

* cited by examiner

CRYOGENIC PUMP FLANGE

FIELD OF THE INVENTION

The present application relates to an arrangement for reducing the condensation of humidity around a flange for a cryogenic pump assembly, and the accumulation of frost and ice, and the freezing of a pump drive unit, that might otherwise be caused by flowing a cryogenic fluid through the flange.

BACKGROUND OF THE INVENTION

Gases can be stored at much higher densities when stored in liquefied form. Compared to a compressed gas stored in gaseous form, a gas can be stored at relatively low pressures if stored in liquefied form below or at its boiling point, such as below about −161.5° C. for a typical blend of natural gas. In this disclosure, "cryogenic" is used to describe fluids at such low temperatures and apparatus, such as a "cryogenic pump" that is designed to handle cryogenic fluids at cryogenic temperatures.

Cryogenic pumps are known for delivering a cryogenic fluid from a thermally insulated storage vessel. Such cryogenic pumps have what is referred to herein as a "cold end" which is immersed in the cryogenic fluid. Typically, cryogenic fluid is fed by gravity into a sump from which it is pumped, or the cold end can comprise a pump assembly that is disposed within the cryogen space defined by storage vessel itself. The drive unit for such a cryogenic pump is referred to herein as the "warm end" and it is usually located outside of the storage vessel to avoid introducing heat from the drive unit into the cold cryogen space defined by the storage vessel. The warm end is also typically located separated spaced apart and/or thermally insulated from the cold end and the delivery pipe exiting from the storage vessel to preventing freezing in the drive unit, especially when the drive unit is a hydraulic drive that uses hydraulic fluid pressure to actuate the cryogenic pump.

In vehicle applications there are often space constraints because of the limited space for mounting the fuel system, and accordingly, a more compact arrangement is preferred. Therefore, it is advantageous to mount the drive unit on, or close to, the flange that seals the opening through which the pump assembly is installed. In addition, it is desirable to reduce the number of heat transfer paths between the cryogen space and the surrounding environment, so it is preferred to have the delivery pipe, in addition to fill pipes and drain pipes, pass through the same flange. However, this can result in freezing of the hydraulic fluid in a hydraulic drive.

The delivery, fill and drain pipes are preferably welded to the flange to fluidly seal the interior of the storage vessel from the external environment. As the temperature of the flange decreases, due to cryogenic fluid, such as liquefied natural gas (LNG), passing through one or more of these pipes, the flange contracts putting stress on these weld joints, which can fatigue and compromise the fluid seal.

The applicant has designed and commercialized a different type of cryogenic pump which comprises a vaporizer integrated with the pump assembly, as disclosed by U.S. Pat. No. 7,607,898. With this arrangement, at the warm end there is no problem with mounting the drive unit on the same flange which the delivery pipe passes through because the vaporized fluid is warmer than the cryogenic fluid.

However, for systems that do not use a cryogenic pump integrated with a vaporizer, there is a need for a compact arrangement that allows for a warm end with a drive unit mounted on or close to the same flange that the delivery pipe passes through.

SUMMARY OF THE INVENTION

An improved flange for a pump comprises first and second faces and a passageway for cryogenic fluid flow extending from the first face to the second face, and at least one of (1) the passageway is for a pipe and comprises a first portion of a first diameter and a second portion of a second diameter that is greater than the first diameter, wherein when the pipe has an outer diameter that is smaller than the second diameter, a gap is formed between the pipe and the passageway where the pipe passes through the second portion; and (2) a first annular groove in one of the first face and the second face and extending around the passageway, wherein the first annular groove in cooperation with the passageway forms a bellows.

The pipe, which can be a fill pipe, a delivery pipe or a drain pipe, can be in contact with an inner wall of the first portion of the passageway. The pump can be a cryogenic pump for pumping a cryogenic fluid from a storage vessel to which the flange is mounted.

In preferred embodiments, the gap is annular. The passageway can be at an oblique angle to at least one of the first face and the second face. A first opening is formed by the intersection of the first portion of the passageway with the first face, and a second opening is formed by the intersection of the second portion of the passageway with the second face. It is preferable that the first opening is further away from a longitudinal axis of a mounting location for a drive unit, compared to the second opening. The second opening can be located within an area surrounded by a sleeve within which the pump is inserted when installed.

An improved flange assembly for a pump comprises a process fluid pipe and a flange. The flange comprises a first face, a second face and a passageway for cryogenic fluid flow extending from the first face to the second face, and at least one of (1) the passageway is for the process fluid pipe and comprises a first portion of a first diameter and a second portion of a second diameter that is greater than the first diameter, wherein when the process fluid pipe has an outer diameter that is smaller than the second diameter, a gap is formed between the process fluid pipe and the passageway where the process fluid pipe passes through the second portion; and (2) a first annular groove in one of the first face and the second face and extending around the passageway, wherein the first annular groove in cooperation with the passageway forms a bellows.

In a preferred embodiment, the flange comprises a bore extending from the first face to the second face and having a diameter equal to the second diameter. The flange assembly further comprises an annulus having an inner diameter equal to the first diameter. The passageway is formed by inserting the annulus into the bore.

The process fluid pipe can be welded to the flange. In a preferred embodiment the flange is disc shaped, but other shapes are possible in other embodiments. The passageway can be at an oblique angle to at least one of the first face and the second face. A first opening is formed by the intersection of the first portion of the passageway with the first face, and a second opening is formed by the intersection of the second portion of the passageway with the second face. In a preferred embodiment the first opening is further away from a longitudinal axis of the flange compared to the second opening.

An improved multi-functional flange for (a) attaching to a corresponding flange on storage vessel, (b) for supporting a pump assembly, and (c) for mounting a hydraulic drive unit, comprises a first face, a second face and a passageway for cryogenic fluid flow extending from the first face to the second face, and at least one of (1) the passageway is for a pipe and comprises a first portion of a first diameter and a second portion of a second diameter that is greater than the first diameter, wherein when the pipe has an outer diameter that is smaller than the second diameter, a gap is formed between the pipe and the passageway where the pipe passes through the second portion; and (2) a first annular groove in one of the first face and the second face and extending around the passageway, wherein the first annular groove in cooperation with the passageway forms a bellows.

The pipe can be in contact with an inner wall of the first portion of the passageway. In a preferred embodiment, the multi-functional flange comprises at least one hydraulic fluid passageway in fluid communication with the hydraulic drive unit.

DETAILED DESCRIPTION OF PREFERRED EMBODIMENT(S)

Figure 1:
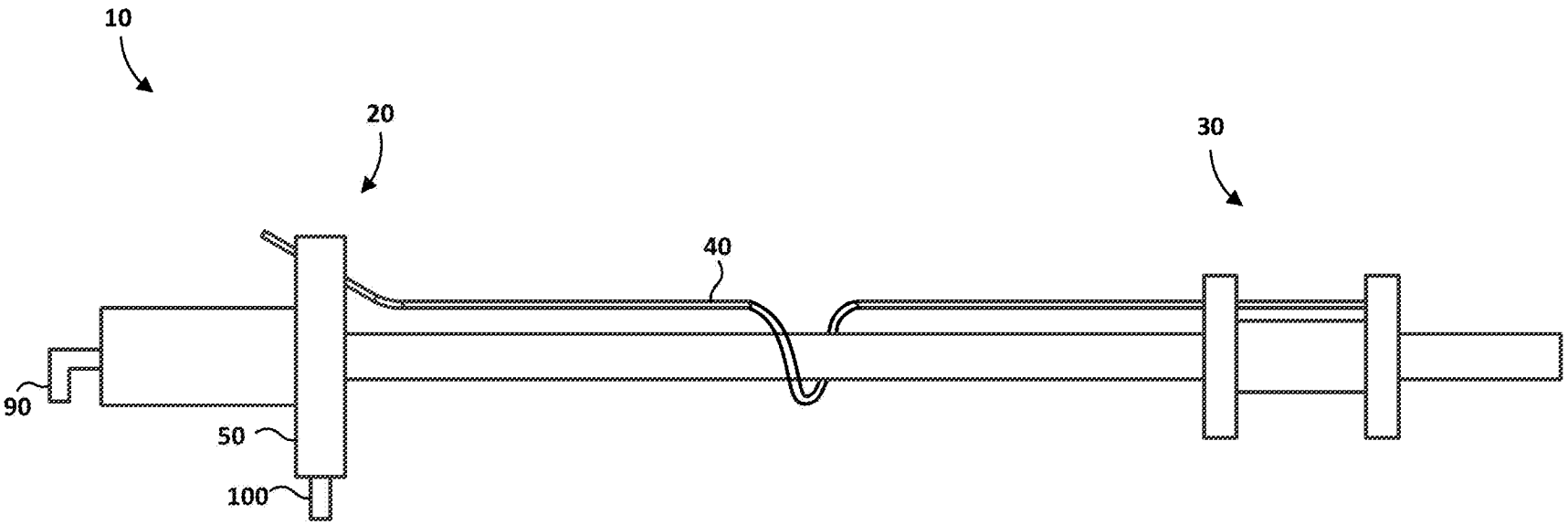
FIG. 1 is a schematic view of a cryogenic pump.

Referring to FIG. 1, there is shown cryogenic pump 10 comprising warm end assembly 20 and cold end assembly 30. Process fluid pipe 40, also known as a delivery pipe, delivers cryogenic fluid pumped from cold end assembly 30 through flange 50 in warm end assembly 20. Pipe 40 connects with external piping (not shown) that delivers the cryogenic fluid to another cryogenic vessel (when the system is transferring cryogenic fluid, for example when filling a vehicle fuel tank) or to an external vaporizer (when the cryogenic fluid is to be used by an end user in gaseous form, for example when the cryogenic fluid is natural gas that is used to fuel an internal combustion engine for powering a vehicle). With reference to both FIGS. 1 and 3, a compact arrangement is shown for a hydraulic drive unit that is mounted adjacent to flange 50 with hydraulic fluid passageways 60 and 70 for delivering hydraulic fluid into and out of cylinder 75 in a manner that is well known for causing piston 80 to produce reciprocating motion. Fittings 90 and 100 connect passageways 60 and 70 to external hydraulic conduits (not shown).

Figure 4:
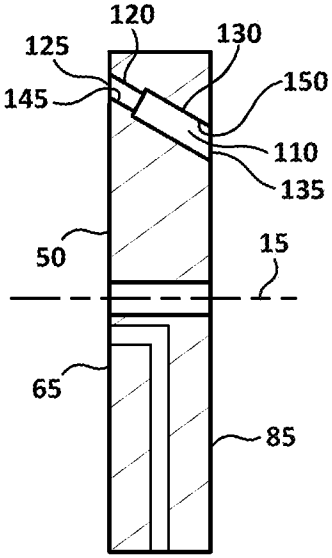
FIG. 4 is a cross-sectional view of the flange of FIG. 3.
Figure 3:
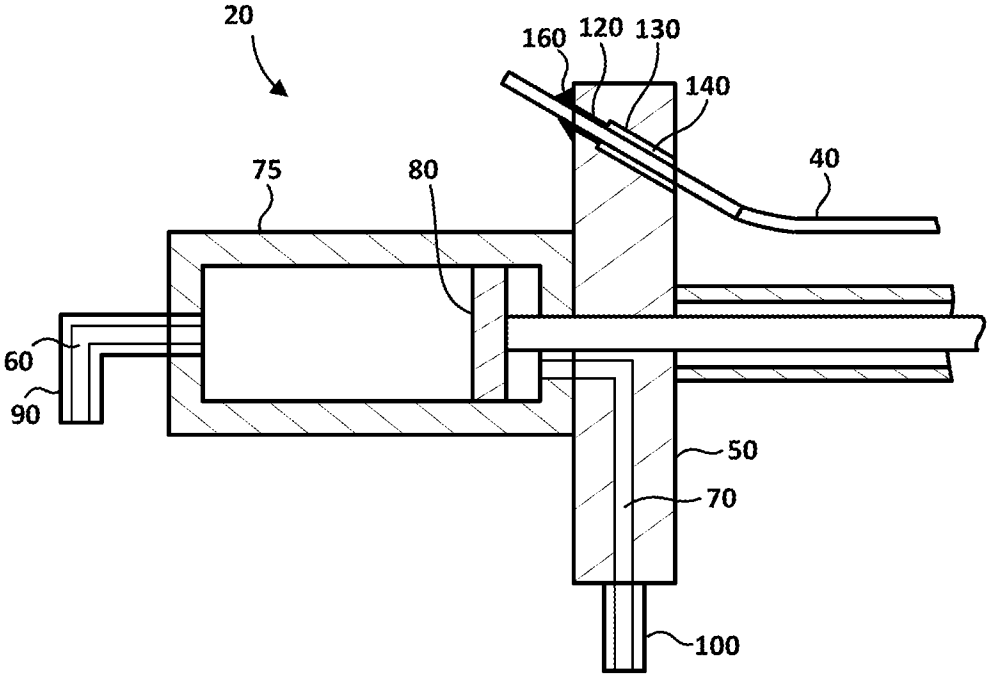
FIG. 3 is a simplified cross-sectional view of a warm end assembly of the pump of FIG. 1 comprising a flange assembly and a flange according to a first embodiment.
Figure 8:
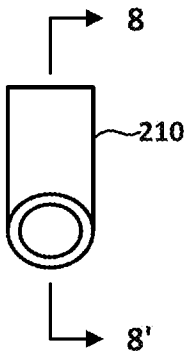
FIGS. 7 and 8 are schematic views of an annulus of the flange of FIG. 4.
Figure 7:
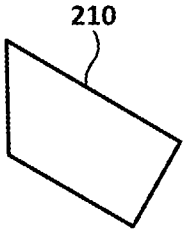
Figure 9:
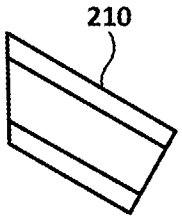
FIG. 9 is a cross-sectional view of the annulus of FIG. 8 taken along line 8-8'.
Figure 6:
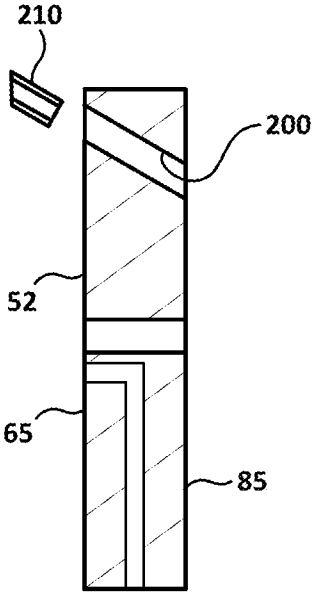
FIG. 6 is an exploded view of the flange of FIG. 4.
Figure 5:
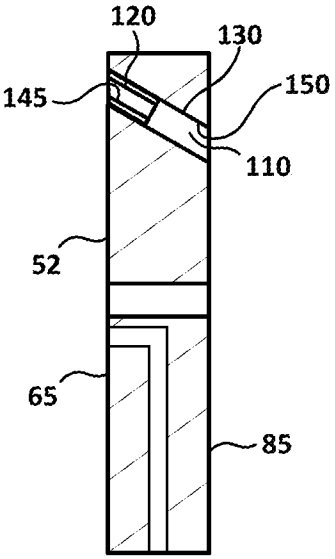
FIG. 5 is a cross-sectional view of a flange of the pump of FIG. 1 according to a second embodiment.

Referring now to FIGS. 3 and 4, passageway 110 is provided in flange 50, extending from opening 125 in face 65 to opening 135 in face 85. Passageway 110 comprises first portion 120 and second portion 130 which in this embodiment are cylindrical bores. The diameter of first portion 120 is less than the diameter of second portion 130. When process fluid pipe 40 is assembled into passageway 110 it is in contact with inner wall 145 of first portion 120, but gap 140 exists between the pipe and inner wall 150 of second portion 130. In other embodiments there can be a finite space between pipe 40 and first portion 120 of passageway 110 at least around a portion of the external surface of the pipe. Gap 140 is an annular gap in the present example. Process fluid pipe 40 is secured to flange 50 by weld 160. Depending upon application requirements, it is possible in other embodiments that a mechanical arrangement or an adhesive can secure pipe 40 to flange 50, or other known techniques can be employed.

The thermal resistance between process fluid pipe 40 and flange 50 is increased by gap 140 since the contact area between the pipe and the flange is reduced. Normally both pipe 40 and flange 50 are made from metal, which is a better conductor of heat than air occupying gap 140. The gap decreases cooling effect on flange 50 caused by the flow of cryogenic fluid through pipe 40, thereby reducing the likelihood of the hydraulic fluid freezing and reducing condensation of humidity and frost/ice build-up around warm end assembly 20.

Figure 2:
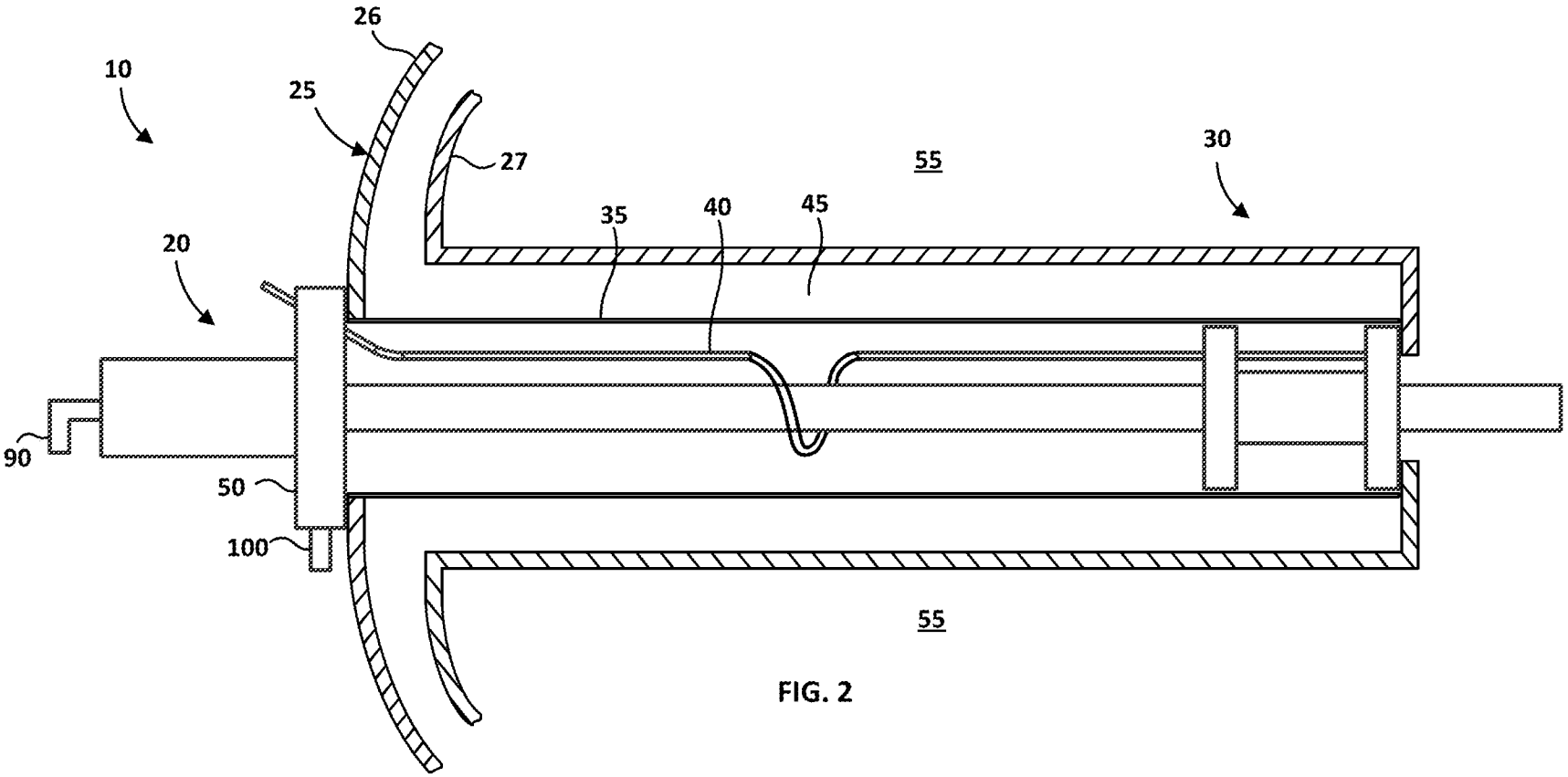
FIG. 2 is a cross-sectional partial view of a double-walled cryogenic vessel with the pump of FIG. 1 inserted into a sleeve.

Passageway 110 is at an oblique angle to both faces 65 and 85, such that opening 125 is further from longitudinal axis 15 than opening 135. Referring now to FIG. 2, when cryogenic pump 10 is installed in storage vessel 25 the majority of its length is preferably housed in sleeve 35 as shown in FIG. 2, so that opening 135 is located within the sleeve, where it is not exposed directly to the cryogen space. Storage vessel 25 is a double-walled vessel comprising outer wall 26 and inner wall 27. In preferred embodiments vacuum space 45 provides additional thermal insulation between sleeve 35 and cryogen space 55. The oblique angle of passageway 110 has the advantage of locating the contact area between pipe 40 and inner wall 145 of passageway 110 further from hydraulic fluid in passageways 60 and 70 and in cylinder 75. This has the effect of increasing the thermal resistance of the heat path between hydraulic fluid and cryogenic fluid in pipe 40. In other embodiments opening 125 can be located the same distance from axis 15 or closer compared to opening 135. In a preferred embodiment, process fluid pipe 40 is secured to flange 50 by weld 160 such that gaseous fuel vapor between sleeve 35 and pump 10 does not escape to the external environment. It is preferred that pipe 40 is welded to flange 50 at opening 125, compared to opening 135 which would tend to increase heat transfer between pipe 40 and cylinder 75 and passageway 70.

Referring now to FIGS. 5-9, there is shown a second embodiment wherein like parts to the previous embodiment and all other embodiments have like reference numerals and may not be discussed in detail, if at all. Flange 52 comprises a bore 200 that extends from face 65 to face 85. An annulus 210 generally in the form of a hollow cylindrical tube is inserted into bore 200 thereby forming passageway 110 and first and second portions 120 and 130. Annulus 210 can be secured to flange 52 in a variety of ways. As non-limiting examples, annulus 210 can be press or interference fit into bore 200, slip fit into the bore and secured by an adhesive or by welding, by a combination of these techniques, or by other known techniques to mechanically secure parts together.

Figure 10:
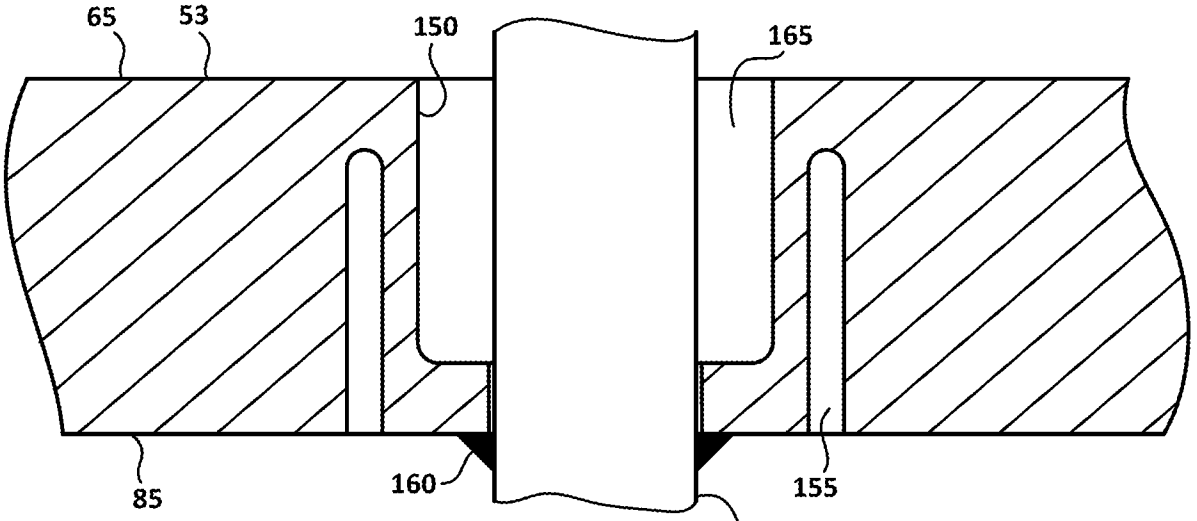
FIG. 10 is a cross-sectional view of a flange assembly of the pump of FIG. 1 comprising a flange according to a third embodiment.
Figure 11:
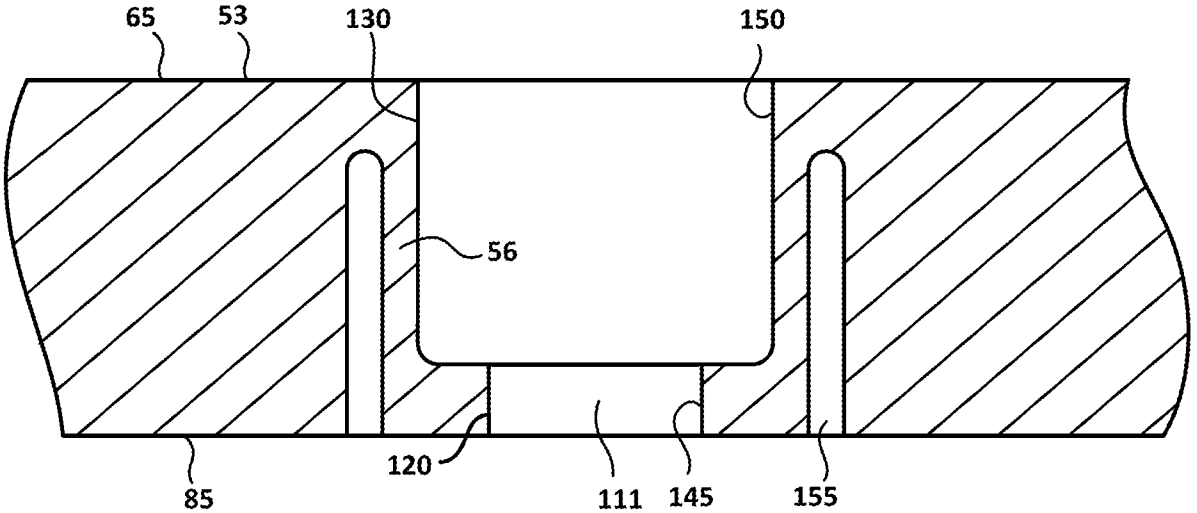
FIG. 11 is a cross-sectional view of the flange of FIG. 10.

Referring now to FIGS. 10 and 11, there is shown a third embodiment of flange 53. Pipe 41 is welded to face 85, and is employed to communicate a cryogenic fluid through flange 53, which depending on the type of pipe (fill pipe, delivery pipe or drain pipe) can flow in either direction. Passageway 111 is similar to passageway 110 in FIG. 4, except that portion 120 of passageway 111 extends from face 85 and portion 130 extends from face 65. Annular groove 155 extends around passageway 111, which in cooperation with the passageway forms a bellows to redirect thermal contractions of flange 53 in a direction that is not constrained, thereby reducing stress on weld 160. Annular portion 56 allows for axially contraction (in the direction of the axis of passageway 111) and flexion when flange 50 thermally contracts. Pipe 41 is normally not anchored within storage vessel 25, and is free to move, such that when a thermal gradient exists between the pipe and flange 53 along portion 56, the portion can contract along the axial direction of passageway 111. The thermal resistance between pipe 41 and flange 53 is also increased by annular groove 155, compared to when annular groove 155 is not employed, due to the narrowing of the metal conduction path from the pipe to the flange. Water vapour can condense and freeze (and/or desublimate) in annular space 165, formed by bore 150 and pipe 41, due to the cold temperatures of the cryogenic fluid in the pipe. Annular space 165 can be filled with a low thermal conductivity material that can contract at a predetermined rate comparable to the rate of temperature change, to displace moisture. Non-limiting examples of such materials comprise glass fiber reinforced plastic, a composite material, and a PTFE foam. Alternatively, the opening into annular space 165 can be sealed at surface 65 to prevent the accumulation of moisture in the space. In general, portion 120 of the passageway can extend from either face 65 or 85, as long as the relative spatial relationship between portion 120 and annular groove 155 is maintained, that is the annular groove extends from the opposite face as portion 120.

Figure 12:
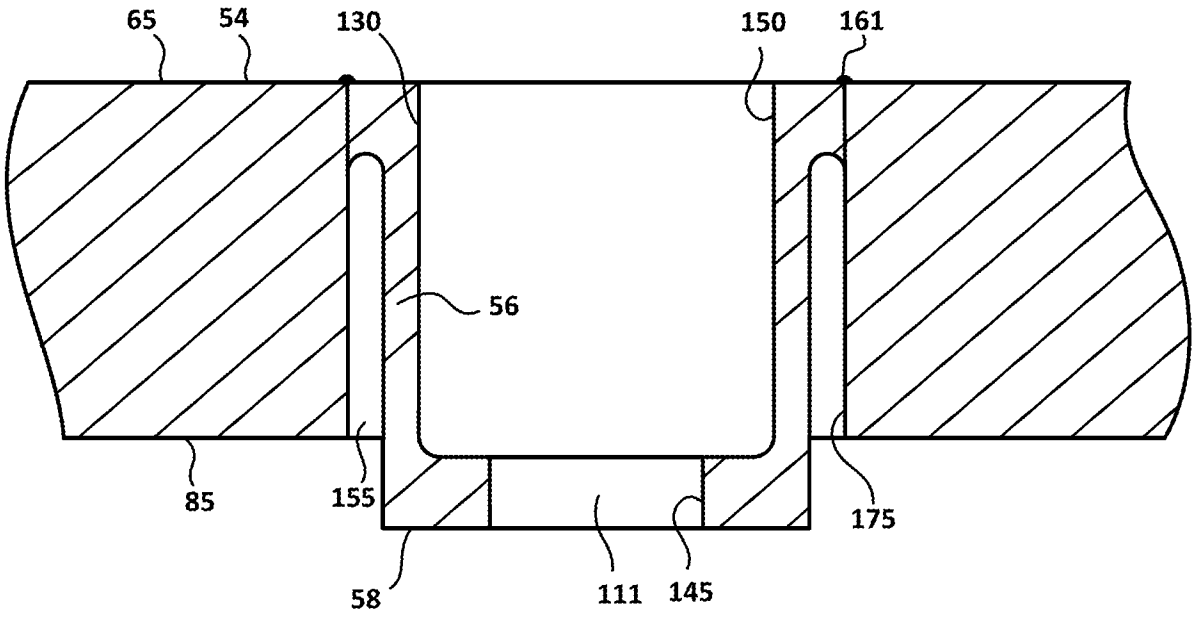
FIG. 12 is a cross-sectional view of a flange of the pump of FIG. 1 according to a fourth embodiment.

Referring now to FIG. 12 a fourth embodiment of flange 54 is shown where passageway 111 and annular groove 155 are formed by placing insert 58 in bore 175, which extends from face 85 to face 65 of the flange. Insert 58 is connected to bore 175 by annular groove weld 161, or alternatively the insert can be epoxied to, threaded into or press-fit into the bore. By using insert 58 the length of annular portion 56 can be increased, which allows for an increased range of axial contraction and flexion when flange 54 thermally contracts, thereby reducing the stress on weld joints between the pipe and the flange. The increased length of annular portion 56 also increases the thermal resistance between the pipe and the flange. In alternative embodiments, flange 55 can be formed as illustrated in FIG. 12 as an integrated component, for example machined from a unitary metal block.

Figure 13:
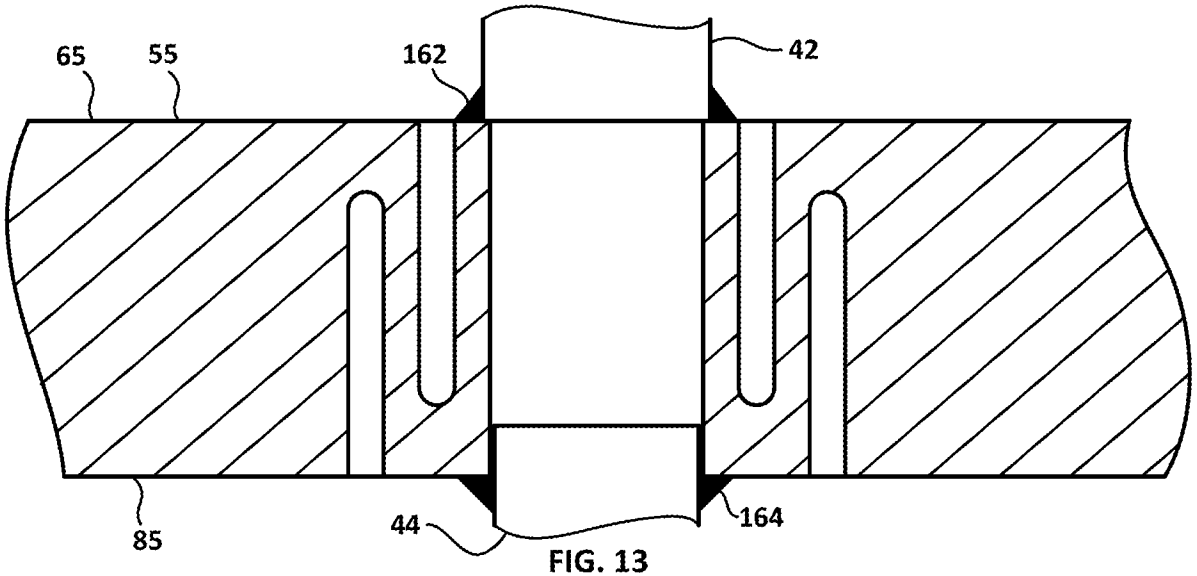
FIG. 13 is a cross-sectional view of a flange assembly of the pump of FIG. 1 comprising a flange according to a fifth embodiment.
Figure 14:
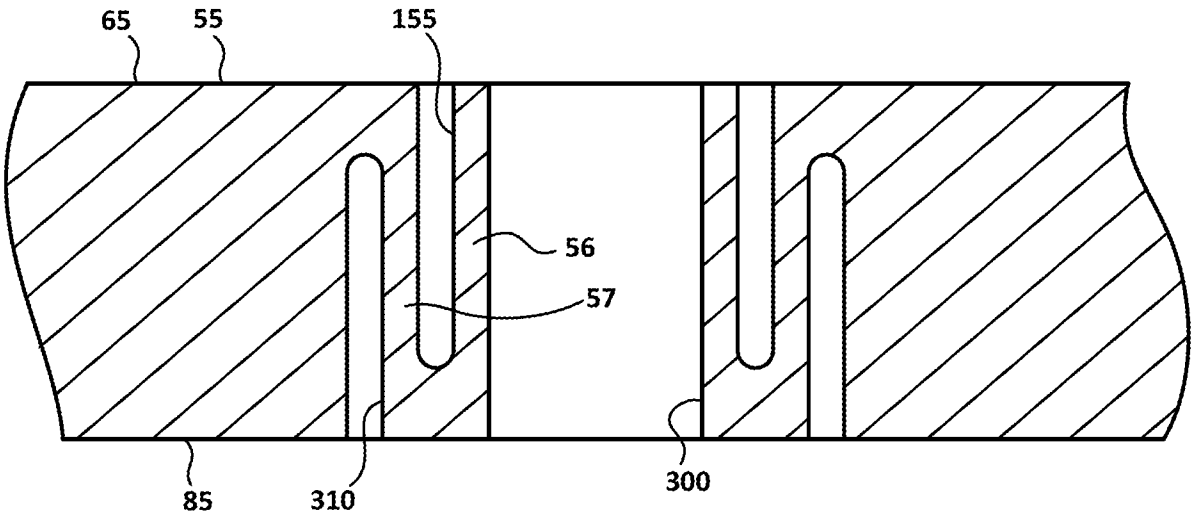
FIG. 14 is a cross-sectional view of the flange of FIG. 13.

Referring now to FIGS. 13 and 14, a fifth embodiment of flange 55 is shown. Pipes 42 and 44 are welded to face 65 and 85 by welds 162 and 164 respectively, and are employed to communicate a cryogenic fluid to and from flange 55, which depending on the type of pipe (fill pipe, delivery pipe or drain pipe) can flow in either direction through a passageway defined by bore 300. In other embodiments pipes 42 and 44 can be one pipe that extends through bore 300 in flange 55. Annular groove 155 around bore 300 extends into flange 55 from face 65, in the illustrated embodiment. Annular groove 310 extends from face 85 into the flange and around both annular groove 155 and bore 300. Annular grooves 155 and 300 in cooperation with bore 300 form a bellows to redirect thermal contractions of flange 50 in a direction that is not constrained, thereby reducing stress on welds 162 and 164. Annular portions 56 and 57 allow for axially contraction (in the direction of the axis of passageway 111) and flexion when flange 50 thermally contracts. In other embodiments, additional annular grooves can be employed, around bore 300, alternating between face 65 and 85, to increase the size of the bellows formed by these grooves, thereby increasing the flexion of the flange during thermal contractions. Annular groove 155, and any other annular grooves that are externally facing with respect to storage vessel 25 (seen in FIG. 2), can be filled with a low thermal conductivity material (such as epoxy), or sealed at the opening, to displace moisture therein thereby reducing the likelihood of frost and/or ice forming in the groove(s).

While particular elements, embodiments and applications of the present invention have been shown and described, it will be understood, that the invention is not limited thereto since modifications can be made by those skilled in the art without departing from the scope of the present disclosure, particularly in light of the foregoing teachings.

The invention claimed is:

1. A flange, comprising:

a first face;

a second face;

a cryogenic fluid flow passageway extending from said first face to said second face, and one of:

(a) a first annular groove in said second face, said cryogenic fluid flow passageway including a first portion with a first diameter extending from said second face and a second portion with a second diameter extending from said first face, said second diameter being greater than said first diameter, a first annular portion between said first annular groove and said cryogenic fluid flow passageway, and said first annular groove extends around said first portion and said second portion of the cryogenic fluid flow passageway; or (b) a first annular groove in one of said first face or said second face and around said cryogenic fluid flow passageway, a first annular portion between said first annular groove and said cryogenic fluid flow passageway, a second annular groove extending from the other of the first or second face as said first annular groove and around said first annular groove, a second annular portion between said second annular groove and said first annular groove.

2. The flange of claim 1, wherein said cryogenic fluid flow passageway includes an inner wall and said inner wall of said cryogenic fluid flow passageway, in use, is in contact with a pipe.

3. The flange of claim 2, wherein said pipe is welded to said second face such that when said first annular portion contracts due to a thermal gradient between said pipe and said flange along said first annular portion said pipe moves with said first annular portion or when said flange thermally contacts said first annular portion flexes.

4. The flange of claim 1, wherein said cryogenic fluid flow passageway, in use, is in fluid communication with a cryogenic fluid storage vessel in which a cryogenic fluid is stored and a pump is in fluid communication with said cryogenic fluid storage vessel, and said pump is configured to, in operation, pump said cryogenic fluid stored in said cryogenic fluid storage vessel to said cryogenic fluid flow passageway.

5. The flange of claim 1, wherein said second portion of said cryogenic fluid flow passageway is (i) at least partially filled with a low thermal conductivity material, (ii) sealed at the second face to reduce accumulation of moisture in said second portion of said cryogenic fluid flow passageway, or (iii) both (i) and (ii).

6. The flange of claim 1, wherein said cryogenic fluid flow passageway, in use, is sealed at the first face by a first pipe that extends around said cryogenic fluid flow passageway and is sealed at the second face by a second pipe that extends around said cryogenic fluid flow passageway.

7. The flange of claim 1, wherein said first annular groove extends more than half-way from the first face to the second face.

8. The flange of claim 1, wherein said second portion of said cryogenic fluid flow passageway extends more than half-way from said first face to said second face.

9. A flange assembly, comprising:
a process fluid pipe;
a flange comprising:
a first face;
a second face;
a cryogenic fluid flow passageway extending from said first face to said second face, and one of:
(a) said process fluid pipe passes through said cryogenic fluid flow passageway, a first annular groove in said second face, said cryogenic fluid flow passageway including a first portion with a first diameter extending from said second face and a second portion with a second diameter extending from said first face, said second diameter being greater than said first diameter, an annular space formed around said process fluid pipe, a first annular portion between said first annular groove and said annular space, and said first annular groove extends around said first portion and said second portion of the cryogenic fluid flow passageway; or
(b) a first annular groove in one of said first face and said second face and extending around said cryogenic fluid flow passageway, a first annular portion between said first annular groove and said cryogenic fluid flow passageway, a second annular groove extending from the other of the first or second face as said first annular groove and around said first annular groove, a second annular portion between said second annular groove and said first annular groove.

10. The flange assembly of claim 9, wherein said flange comprises a bore extending from said first face to said second face, said flange assembly further comprises an insert and said cryogenic fluid flow passageway formed by inserting said insert into said bore.

11. The flange assembly of claim 9, wherein said process fluid pipe is welded to said flange.

12. The flange of claim 9, wherein said annular space is (i) filled with a low thermal conductivity material, (ii) sealed at the second face to reduce accumulation of moisture in said annular space or (iii) both (i) and (ii).

13. The flange assembly of claim 9, wherein the process fluid pipe is a first process fluid pipe and further comprising a second process fluid pipe, wherein the first process fluid pipe is in fluid sealing contact with said first face around said cryogenic fluid flow passageway within said first annular groove and said second process fluid pipe is in fluid sealing contact with said second face around said cryogenic fluid flow passageway within said second annular groove.

14. The flange assembly of claim 9, wherein said process fluid pipe is welded to said second face such that when said first annular portion contracts due to a thermal gradient between said pipe and said flange along said first annular portion said pipe moves with said first annular portion or when said flange thermally contracts said first annular portion flexes.

15. The flange assembly of claim 9, wherein said first annular groove extends more than half-way through said flange.

16. The flange assembly of claim 9, wherein said second portion of said cryogenic fluid flow passageway extends more than half-way through said flange.

17. A cryogenic pump system, comprising:
a storage vessel;
a pipe to transport cryogenic fluid; and
a flange coupled to said storage vessel and said pipe, said flange comprising:
a first face;
a second face;
a cryogenic fluid flow passageway extending from said first face to said second face, and one of:
(a) said pipe passing through said passageway, a first annular groove in said second face, said cryogenic fluid flow passageway including a first portion with a first diameter extending from said second face and a second portion with a second diameter extending from said first face, said second diameter being greater than said first diameter, an annular space formed around said pipe, and a first annular portion between said first annular groove and said annular space, and said first annular groove extends around the first portion and the second portion of the cryogenic fluid flow passageway, wherein said flange is configured with said pipe connected with said first annular portion at said second face such that when said first annular portion contracts due to a thermal gradient between said first pipe and said flange along said first annular portion said first pipe moves with said first annular portion; or
(b) a first annular groove in one of said first face and said second face and extending around said cryogenic fluid flow passageway, a first annular portion between said first annular groove and said cryogenic fluid flow passageway, a second annular groove extending from the other of the first or second face as said first annular groove and around said first annular groove, a second annular portion between said second annular groove and said first annular groove, wherein said flange is configured with said pipe connected with said first annular portion such that when said first annular portion contracts due to a thermal gradient between said pipe and said flange along said first annular portion said pipe moves with said first annular portion.

18. The cryogenic pump system of claim 17, wherein said flange further comprises at least one hydraulic fluid passageway in fluid communication with a hydraulic drive unit.

19. The cryogenic pump system of claim 17, wherein element (a) of the flange further comprises a second annular groove that extends from the other of the first or second face as said first annular groove and around said first annular groove, said first and second annular grooves in cooperation with said cryogenic fluid flow passageway forms a bellows.

20. The cryogenic pump system of claim 17, wherein said annular space (i) filled with a low thermal conductivity material, (ii) sealed at the second face to reduce accumulation of moisture in said annular space, or (iii) both (i) and (ii).

21. The cryogenic pump system of claim 17, wherein the pipe is a first pipe and further comprising a second pipe, wherein the first pipe is in fluid sealing contact with said first face around said cryogenic fluid flow passageway and said second pipe is in fluid sealing contact with said second face around said cryogenic fluid flow passageway.

22. The cryogenic pump system of claim 17, wherein said second portion of said cryogenic fluid flow passageway extends more than half-way through said flange.

23. The cryogenic pump system of claim 17, wherein said first annular groove extends more than half-way through said flange.

* * * * *